US005743203A

United States Patent [19]

NcNamara

[11] Patent Number: 5,743,203

[45] Date of Patent: Apr. 28, 1998

[54] BOAT HULL AND DECK ASSEMBLY

[75] Inventor: Don B. NcNamara, Menomonee Falls, Wis.

[73] Assignee: Outboard Marine Corporation, Waukegan, Ill.

[21] Appl. No.: 627,022

[22] Filed: Apr. 3, 1996

[51] Int. Cl.[6] ..... B63B 3/04

[52] U.S. Cl. ..... 114/85; 114/88; 114/219; 114/355; 114/357

[58] Field of Search ..... 114/355, 357, 114/85, 88, 356, 219

[56] References Cited

U.S. PATENT DOCUMENTS

| | | | |
|---|---|---|---|
| 1,816,365 | 7/1931 | De Witt . | |
| 3,065,724 | 11/1962 | Tritt | 114/88 |
| 3,811,141 | 5/1974 | Stoeberl | 9/6 |
| 3,827,092 | 8/1974 | Butler | 9/6 |
| 3,871,043 | 3/1975 | Davidson et al. | 114/88 |
| 3,877,095 | 4/1975 | Ivy | 9/6 |
| 4,094,027 | 6/1978 | Vernon | 9/6 P |
| 4,457,249 | 7/1984 | Disen | 114/88 |
| 4,635,580 | 1/1987 | Nishida | 114/343 |
| 4,660,498 | 4/1987 | Madison | 114/347 |
| 4,741,284 | 5/1988 | Madison | 114/357 |
| 4,966,092 | 10/1990 | Illingworth | 114/356 |
| 5,337,692 | 8/1994 | Troiani | 114/61 |
| 5,558,038 | 9/1996 | McNamara | 114/355 |

FOREIGN PATENT DOCUMENTS

| | | | |
|---|---|---|---|
| 159998 | 12/1979 | Japan | 114/357 |
| 175487 | 10/1982 | Japan | 114/355 |
| 1142078 | 2/1969 | United Kingdom | 114/357 |

*Primary Examiner*—Sherman Basinger
*Attorney, Agent, or Firm*—Jones, Day, Reavis & Pogue

[57] ABSTRACT

Disclosed herein is a boat comprising a hull member including a gunwale having an outer peripheral surface, and a deck member including a depending peripheral portion including an inner concave surface engaged with the outer surface of the hull member with an interference fit.

18 Claims, 2 Drawing Sheets

BOAT HULL AND DECK ASSEMBLY

BACKGROUND OF THE INVENTION

The invention relates generally to boats, and more particularly, to boats fabricated of fiberglass and including a deck piece or member and a hull piece or member. Still more particularly, the invention relates to constructions for, and methods of, joining together the deck piece or member and the hull piece or member.

In the past, as shown in FIG. 1, during boat construction, the lower, vertically extending peripheral portion 2 of a deck member 3 was telescopically overlaid in outward relation upon the vertically extending upper end or gunwale portion 4 of a hull member 5. The lower portion 2 of the deck member 3 and the upper or gunwale portion 4 of the hull member 5 were fastened together by a plurality of fasteners, such as screws 6, which extended through the overlaid upper and lower portions 2 and 4 and into a wooden screw strip 7 located inwardly of the upper portion 4 of the hull member 5.

Outwardly of the depending portion 2 of the deck member 3, it was common to fix a metallic channel member 8, and to insert into the channel member 8, a fender strip 9 which was fabricated of suitable material, such as rubber. The channel member 8 was fixed to the boat by suitable fasteners, such as screws 10, which pierced through the channel member 8, through the lower portion 2 of the deck member 3, through the upper portion 4 of the hull member 5, and into the screw strip 7.

Attention is also directed to the following U.S. Patents:

U.S. Pat. No. 1,816,365, Dewitt, issued Jul. 28, 1931

U.S. Pat. No. 3,811,141, Stoeberl, issued May 21, 1974

U.S. Pat. No. 3,827,092, Butler, issued Aug. 6, 1974

U.S. Pat. No. 3,877,095, Ivy, issued Apr. 15, 1975

U.S. Pat. No. 4,094,027, Vernon, issued Jun. 13, 1978

U.S. Pat. No. 4,457,249, Disen, issued Jul. 3, 1984

U.S. Pat. No. 4,635,580, Nishida, issued Jan. 13, 1987

U.S. Pat. No. 4,660,498, Madison, issued Apr. 28, 1987

U.S. Pat. No. 4,741,284, Madison, issued May 3, 1988

U.S. Pat. No. 5,337,692, Troiani, issued Aug. 16, 1994

SUMMARY OF THE INVENTION

The invention provides a boat comprising a hull member including a gunwale having an outer peripheral surface, and a deck member including a depending peripheral portion including an inner concave surface engaged with the outer surface of the hull member with an interference fit.

The invention also provides a boat comprising a hull member including a gunwale having an outer peripheral surface, a deck member including a depending peripheral portion, and a fender strip including an inside surface which is inwardly concave and in engagement with the outer convex surface of the gunwale with an interference fit, an outwardly extending fender portion, and an upwardly open recess located between the inside surface and the fender portion and receiving the peripheral portion of the deck member.

The invention also provides a boat including a deck member having a depending portion including an inner downwardly open recess, and an outer downwardly open recess, and a hull member including a gunwale having a lower portion having a thickness, an upper portion projecting upwardly from the lower portion, having a thickness less than the thickness of the lower portion, and received in the inner recess in the depending portion of the deck member, and a laterally extending portion extending from the lower portion and including an upwardly extending leg cooperating with the upper portion to define an upwardly open recess in vertical alignment with the outer recess of the depending portion of the deck member, a fender strip including an inner portion received in the inner recess of the depending portion of the deck member and in the upwardly open recess defined by the lower portion and the laterally extending portion of the hull member, and an outer portion defining a fender, and adhesive fixing together the depending portion of the deck member and the gunwale portion of the hull member.

The invention also provides a deck member having a depending portion including a downwardly projecting portion having an inner surface, and a laterally extending portion extending outwardly from the downwardly projecting portion and including a downwardly extending leg cooperating with the downwardly projecting portion to define a downwardly open recess, and a hull member comprising a gunwale having a lower portion having a thickness, an upper portion projecting upwardly from the lower portion, having a thickness less than the thickness of the lower portion, and engaging the inner surface of the downwardly projecting portion, and a laterally extending portion extending outwardly from the lower portion and including an upwardly extending leg cooperating with the upper portion to define an upwardly open recess in vertical alignment with the recess of the depending portion of the deck member, and a fender strip including an inner portion received in the downwardly open recess defined by the downwardly projecting portion and the laterally extending portion of the depending portion of the deck member and in the upwardly open recess defined by the lower portion and the laterally extending portion of the hull member, and an outer portion defining a fender.

The invention also provides a method of manufacturing a boat comprising the steps of fabricating a deck member of resiliently flexible material and including a downwardly depending peripheral portion having an endless lower sub-portion with a first given peripheral dimension, fabricating a hull member including a gunwale portion with an endless upper part having a second given peripheral dimension more than the first given peripheral dimension, resiliently enlarging the endless lower part of the depending peripheral portion of the deck member to a third dimension at least as great as the second given peripheral dimension, locating the lower part of the downwardly depending peripheral portion of the deck member in surrounding telescopic relation to the upper part of the gunwale portion of the hull member, and relaxing the lower part of the downwardly depending peripheral portion of the deck member so as to tightly engage the upper part of the gunwale portion of the hull member.

The invention also provides a method of manufacturing a boat comprising the steps of fabricating a deck member including a peripheral portion having a downwardly projecting sub-portion and a downwardly open recess, fabricating a hull member including a gunwale portion with an upwardly extending sub-portion extending into the downwardly open recess, fabricating one of the hull member and the deck member with a screw strip formation including an interior wooden member, and threading a screw through the downwardly projecting sub-portion, through the upwardly extending sub-portion, through the screw strip formation, and into the wooden strip.

The invention also provides a method of manufacturing a boat comprising the steps of fabricating a deck member including a peripheral portion having a downwardly projecting sub-portion, a screw strip formation including an interior wooden member, and a downwardly open recess located between the downwardly projecting sub-portion and the screw strip formation, fabricating a hull member including a gunwale portion with an upwardly extending sub-portion, locating the deck member relative to the hull member so that the upwardly extending sub-portion extends into the downwardly open recess, and threading a screw through the downwardly projecting sub-portion, through the upwardly extending sub-portion, through the screw strip formation, and into the wooden strip.

The invention also provides a method of manufacturing a boat comprising the steps of fabricating a deck member including a peripheral portion having a vertically downwardly projecting sub-portion, fabricating a hull member including a gunwale portion with a screw strip formation including a vertically extending wall portion and an interior wooden member, locating the deck member relative to the hull member so that the vertically downwardly extending sub-portion of the deck member engages the vertically extending wall portion of the hull member, and threading a screw through the vertically downwardly projecting sub-portion, through the vertically extending wall portion, through the screw strip formation, and into the wooden strip.

Other features and advantages of the invention will become apparent to those skilled in the art upon review of the following detailed description, claims and drawings.

Figure 1:
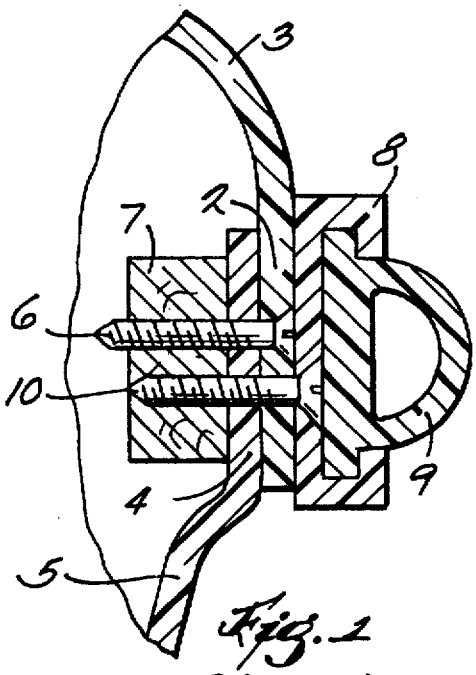
Fig. 1 PRIOR ART
FIG. 1 is a fragmentary view of a portion of a prior art boat.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Figure 2:
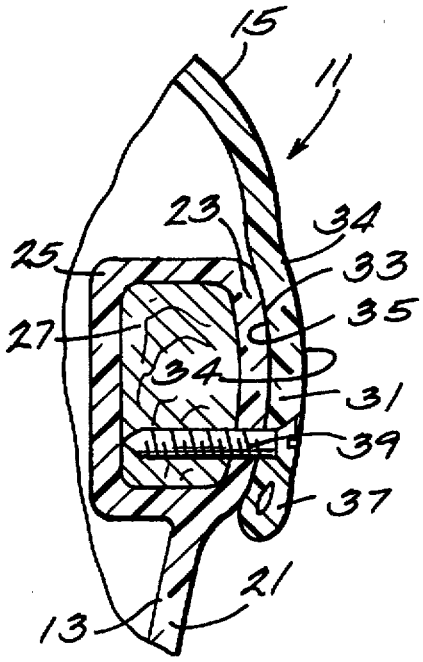
FIG. 2 is a fragmentary view of a portion of a boat incorporating various of the features of the invention.

Shown fragmentarily in FIG. 2 is a first embodiment of a boat 11 including a hull member 13 and a deck member 15. The hull member 13 is preferably fabricated from fiber glass plastic material, using the resin transfer molding method. The deck member 15 is also preferably fabricated from resiliently flexible material, such as fiber glass plastic material, using the resin transfer molding method.

The hull member 13 comprises a main or lower portion 21 and, at the top thereof, a gunwale or upper portion 23 which can be fabricated with a box-like screw strip formation or portion 25 enclosing a wooden screw strip 27, as disclosed in U.S. application Ser. No. 08/436586 which was filed on May 8, 1995, now U.S. Pat. No. 5,558,038, the disclosure of which is incorporated herein by reference. The gunwale or upper portion 23 of the hull member 13 includes an endless upper part having a first given peripheral dimension.

The deck member 15 includes a main portion (not generally shown) from which depends a generally downwardly depending peripheral portion 31 having an endless lower part with a second given peripheral dimension less than the first peripheral dimension.

The hull member 13 and the deck member 15 are assembled or fixed to each other (after fabrication thereof) by resiliently enlarging the endless lower part of the depending peripheral portion of the deck member to a third peripheral dimension at least as great as the second given peripheral dimension, by locating the lower part of the downwardly depending peripheral portion of the deck member in surrounding telescopic relation to the upper part of the gunwale or upper portion 23 of the hull member 13, and by relaxing the lower part of the downwardly depending peripheral portion 31 of the deck member 15 so as to tightly engage the upper part of the gunwale or upper portion 23 of the hull member 13, thus fixing the hull member 13 and the deck member 15 to each other with a resiliently obtained press fit, or snap fit, or interference fit, or compression fit.

More particularly, in the construction shown in FIG. 2, the gunnel or upper portion 23 of the hull member 13 includes a generally vertically extending and outwardly convex upper part or surface 33. The downwardly depending peripheral portion 31 of the deck member 15 includes a generally vertically extending outer lower part or surface 34 which, preferably, is outwardly convex in shape, and a generally vertically extending and inwardly convex surface 35 which tightly engages the convex surface 33 of the gunwale or upper portion 23 to provide a snap fit, or press fit, or interference fit, or compression fit.

Still more particularly, the gunwale portion or upper portion 23 of the hull member 13 and the downwardly depending peripheral portion 31 of the deck member 15 are dimensioned relative to each other and the downwardly depending peripheral portion 31 of the deck member 15 has a thickness which provides a sufficient degree of resilient flexibility so as to permit sufficient outward deflection or bending or spreading of the lower end thereof to enable passage of the lower end of the depending portion 31 of the deck member 15 past the outermost point on the outwardly convex surface 33 of the gunwale or upper portion 23 of the hull member 13. After such passage, the lower end of the depending portion 31 of the deck member 15 resiliently returns to its normal shape or position, thereby tightly engaging together the convex and concave surfaces 33 and 35 to snugly attach or fix the deck member 15 on the hull member 13. If desired, the lowermost edge of the depending portion 31 of the deck member 15 can be formed with an enlarged bead 37 to assist in rigidifying the connection of the deck member 15 to the hull member 13.

If desired, the tight connection or fix of the deck member 15 and the hull member 13 can be augmented by employment of a series of suitable fasteners, such as screws 39. Alternatively, the hull member 13 and the deck member 15 can be additionally fixed to each other by suitable adhesive, as will be described hereinafter.

Figure 3:
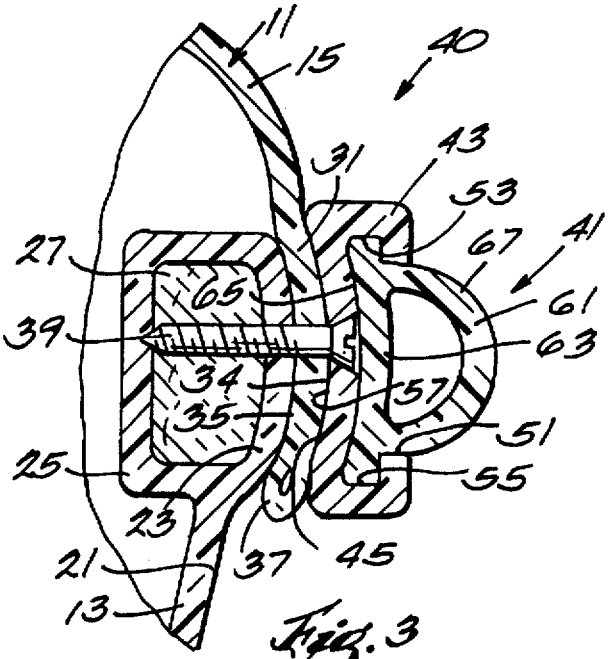
FIG. 3 is a fragmentary view of a portion of another boat incorporating various of the features of the invention.

Shown fragmentarily in FIG. 3 is another embodiment of a boat 40 which is constructed generally identically to the boat 11 shown in FIG. 2 except as described hereinafter in connection with the additional provision of a fender assembly 41. More particularly, in the construction shown in FIG. 3, the fender assembly 41 includes a fender mounting member 43 which is fabricated from a suitable resiliently flexible plastic material and which includes an inner concave surface 45 which is adapted to tightly or snugly engage the outwardly convex outer surface 34 of the downwardly depending portion 31 of the deck member 15. The fender mounting member 43 also includes a fender mounting portion 51 including an upper, downwardly open, recess 53 and a lower, upwardly open, recess 55 which are connected by a outwardly convexly curved surface 57.

The fender assembly 41 also includes a fender member 61 which is fabricated of resiliently flexible material, such as rubber, and which includes a mounting portion 63 having an inwardly concavely shaped wall 65 which, at the ends thereof, extends into the upper and lower recesses 53 and 55 and which tightly or snugly engages the outwardly convex surface 57 of the fender mounting member 43. The fender member 61 also includes a fender portion 67 which extends from the mounting portion 63 in a generally semi-circular shape and, preferably, has a hollow interior. The construction of the fender member 61 is essentially the same as the prior art fender strip 9.

Figure 4:
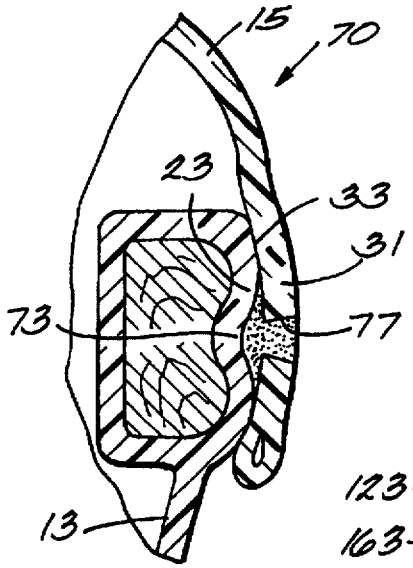
FIG. 4 is a fragmentary view of a portion of still another boat incorporating various of the features of the invention.

Shown fragmentarily in FIG. 4 is another embodiment of a boat 70 which is constructed generally identically to the boat shown in FIG. 2, except as described hereinafter in connection with an additional provision for fixing or bonding the hull member 13 and the deck member 15. In this last regard, in the boat 70, the outer convex surface 33 of the gunwale or upper portion 23 includes a centrally located depression or recess 73, and the central part of the downwardly depending peripheral portion 31 of the deck member 15 includes an aperture or opening 77 which communicates with the recess 73, which is preferably of conical, outwardly diverging shape, and which has an inner dimension substantially less than the outer dimension of the recess 73, thereby exposing substantial surfaces of both the gunwale or upper portion 23 and the downwardly depending peripheral portion 31 to each other. The opening 77 facilitates deposit or filling into the recess 73 and into the opening or aperture 77 of adhesive which serves to additionally bind together the deck member 15 and the hull member 13.

Figure 5:
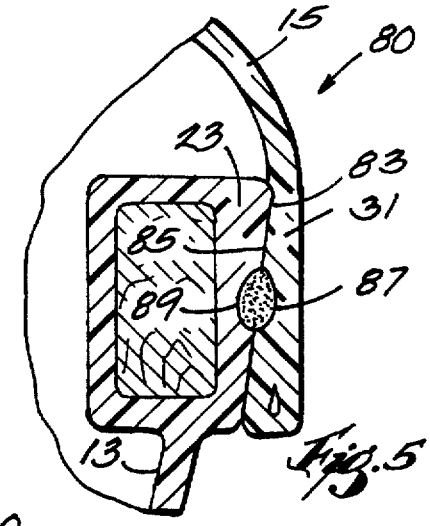
FIG. 5 is a fragmentary view of a portion of still another boat incorporating various of the features of the invention.

Shown fragmentarily in FIG. 5 is still another embodiment of a boat 80 which is constructed generally identically to the boat shown in FIG. 2, except as described hereinafter in connection with the additional provision for fixing or bonding together of the hull member 13 and the deck member 15. In the boat 80 shown in FIG. 5, the adjacent surfaces 83 and 85 of the gunwale or upper portion 23 of the hull member 13 and the downwardly depending peripheral portion 31 of the deck member 15 are generally flat and inclined so that the dimension of the endless peripheral surface 83 of the gunwale or upper portion 23 adjacent the top thereof is larger than the dimension of the lower end of the endless peripheral surface 85 of the downwardly depending peripheral portion 31, thereby requiring the deck member 15 to be resiliently deformed to permit assembly with the hull member 13. The surfaces 83 and 85 respectively include recesses 87 and 89 which are in registry or alignment with each other and which are filled with a suitable adhesive.

In assembly of the deck member 15 and the hull member 13, the lower end of the downwardly depending peripheral portion 31 of the deck member 15 is resiliently spread and hull member 13 and the deck member 15 are telescoped past each other. Thereafter, the downwardly depending peripheral portion 31 of the deck member 15 is allowed to resume its normal shape, thereby engaging the surfaces 83 and 85 in tight engagement. The adhesive is then permitted to cure and to bond together the deck member 15 and the hull member 13.

Figure 6:
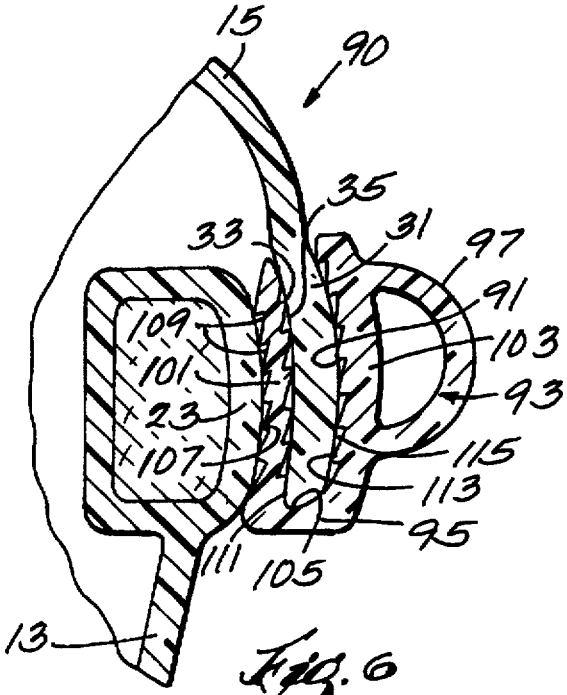
FIG. 6 is a fragmentary view of a portion of still another boat incorporating various of the features of the invention.

Shown fragmentarily in FIG. 6 is still another embodiment of a boat 90 which is constructed generally identically to the boat shown in FIG. 2, except as described hereinafter. The boat 90 comprises a one-piece fender member 93 which is fabricated of resiliently flexible material, such as rubber, and includes a portion 91 which is sandwiched between the gunwale or upper portion 23 of the hull member 13 and the downwardly depending peripheral portion 31 of the deck member 15.

More particularly, in the construction shown in FIG. 6, the fender member 93 includes a u-shaped mounting portion 95 and a fender portion 97 extending outwardly from the mounting portion 95. The u-shaped mounting portion 95 includes inner and outer arcuately extending legs 101 and 103 which are laterally spaced to define therebetween an upwardly open recess 105 which receives, in snug engagement, the downwardly depending peripheral portion 31 of the deck member 15. The inner leg 101 includes an inwardly concave surface 107 which engages the outwardly convex surface 33 of the gunwale or upper portion 23 of the hull member 13 and which, preferably, is serrated or toothed, as shown, to provide a plurality of small recesses 109 for containing adhesive which bonds together the hull member 13 and the fender member 93. The inner leg 101 also includes an outwardly convex surface 111 and the outer leg 103 includes an inwardly concave surface 113, which surfaces 111 and 113 respectively engage the inner concave surface 35 and the outer convex surface 34 of the downwardly depending peripheral portion 31 of the deck member 15 and are preferably serrated or toothed, as shown, to provide a plurality of small recesses 115 for containing adhesive which bonds together the deck member 15 and the fender member 93.

Figure 7:
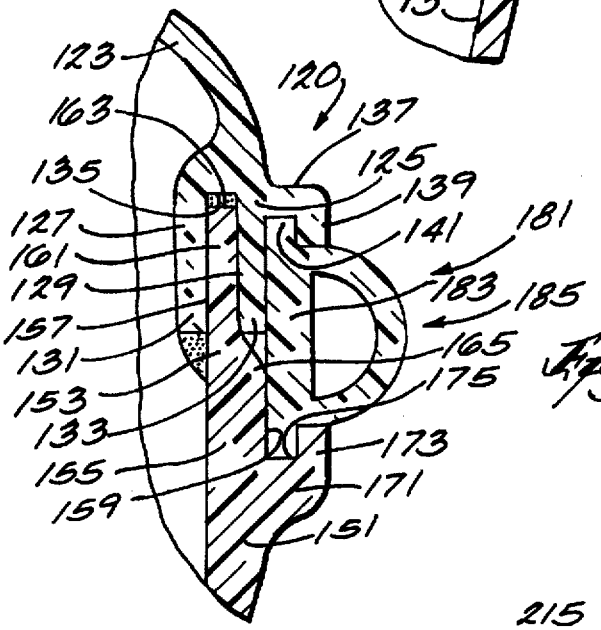
FIG. 7 is a fragmentary view of a portion of still another boat incorporating various of the features of the invention.

Shogun fragmentarily in FIG. 7 is still another embodiment of a boat 120 including a deck member 123 having a downwardly depending peripheral portion 125 including laterally spaced and vertically extending inner and outer sub-portions 127 and 129 which respectively include lower ends 131 and 133 and which define therebetween an inner downwardly open recess or slot 135. In addition, the downwardly depending peripheral depending portion 125 includes a laterally extending sub-portion 137 extending outwardly therefrom and including a downwardly extending leg 139, cooperating with the outer sub-portion 129, to define an outwardly located, downwardly open recess 141.

In addition, the boat 120 includes a hull member 151 with a gunwale or upper portion 153 having a middle sub-portion 155 having inner and outer surfaces 157 and 159 spaced at a given thickness, and an upper sub-portion 161 which projects upwardly from the middle sub-portion 155, which has an upper end 163 and a thickness less than the thickness of the middle sub-portion 155, and which is received in the inner slot or recess 135 in the downwardly depending peripheral portion 125 of the deck member 123.

Located adjacent the juncture of the outer surface 159 of the middle sub-portion 155 and the upper sub-portion 161 is a shoulder 165. In addition, the gunwale or upper portion 153 includes a laterally outwardly extending sub-portion 171 extending from the middle sub-portion 155 and including an upwardly extending leg 173 cooperating with the outer surface 159 of the middle sub-portion 155 to define an upwardly open recess 175 in vertical alignment with the outer recess 141 of the downwardly depending peripheral portion 125 of the deck member 123.

The boat 120 also includes a fender strip 181 including an inner portion 183 having upper and lower ends respectively received in the outer downwardly open recess 141 of the downwardly depending peripheral portion 125 of the deck member 123 and in the upwardly open recess 175 defined by the middle sub-portion 155 and the laterally extending sub-portion 171 of the hull member 151. The fender strip 181 also includes an outer semi-cylindrical portion which extends from the inner portion and which defines a fender 185.

The downwardly depending peripheral portion 125 of the deck member 123 and the gunwale or upper portion 153 of the hull member 151 are united or fixed together by adhesive. More particularly, in the specifically illustrated construction, the adhesive is located between the lower end 131 of the inner sub-portion 127 and the inner surface 157 of the middle sub-portion 155 of the gunwale or upper portion 153 of the hull member 151, and between the lower end 133 of the outer sub-portion 129 and the shoulder 165, and between the upper end 163 of the upper sub-portion 161 of the gunwale or upper portion 153 of the hull member 151 and the upper end of the inner recess or slot 135 of the downwardly depending peripheral portion 125 of the deck member 123.

If desired, the boat 120 can also include a series of suitable fasteners, such as screws, (not shown) extending through the inner and outer sub-portions 127 and 129 of the downwardly depending peripheral portion 125 of the deck member 123, and through the upper sub-portion 161 of the gunwale or upper portion 153 of the hull member 151.

Figure 8:
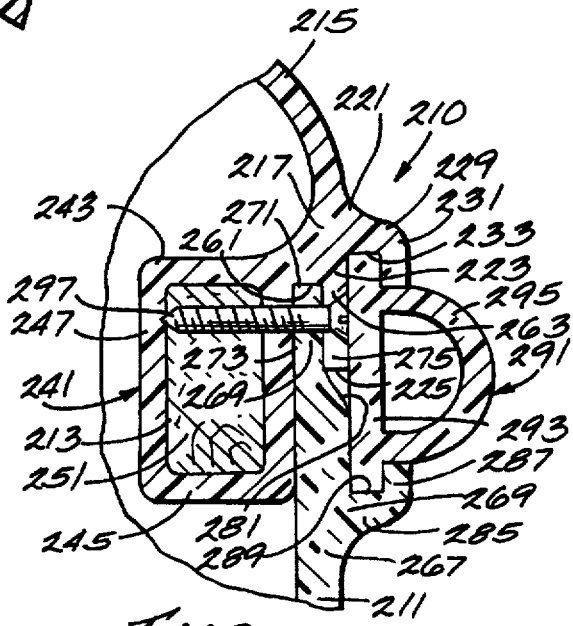
FIG. 8 is a fragmentary view of a portion of still another boat incorporating various of the features of the invention.

Shown fragmentarily in FIG. 8 is still another embodiment of a boat 210 including a hull member 211 having a gunwale or upper portion 213 and a deck member 215 having a downwardly depending peripheral portion 217. In the boat 210 shown in FIG. 8, the downwardly depending peripheral portion 217 of the deck member 215 includes a downwardly projecting sub-portion 221 having a generally vertically extending inside surface 223, and a lower end 225. In addition, the downwardly depending peripheral portion 217 includes a laterally extending sub-portion 229 extending outwardly from the downwardly projecting portion 217 and including a downwardly extending leg 231 cooperating with the downwardly projecting sub-portion 229 to define a downwardly open recess 233.

The downwardly depending peripheral portion 217 of the deck member 215 also includes a box-like screw strip formation 241 which includes upper and lower generally horizontal wall portions 243 and 245 and inner and outer generally vertical wall portions 247 and 249, and an interior wooden screw strip 251. More specifically, in the construction shown in FIG. 8, the outer vertical wall 249 and the upper generally horizontal wall 243 of the box-like formation 241 extend from the downwardly depending peripheral portion 217 and define, with the inside surface 223 of the downwardly projecting sub-portion 221, a downwardly open slot or recess 261 having an upper end 263.

The gunwale or upper portion 213 of the hull member 211 includes a middle sub-portion 267 having a given thickness and an upper sub-portion 269 extending upwardly from the middle sub-portion 267, having a thickness substantially less than the given thickness, and projecting upwardly into the downwardly open slot 233 of the downwardly depending peripheral portion 217 of the deck member 215. The upper sub-portion 269 has an upper end 271 and inner and outer surfaces 273 and 275 which are spaced at a thickness therebetween such that the surfaces 273 and 275 respectively engage the inner surface 223 of the downwardly projecting sub-portion 221 and the outer surface of the vertical wall 249 of the box-like screw strip formation 241. Adjacent the juncture of the middle and upper sub-portions 267 and 269, the outer surface of the middle sub-portion 267 defines a shoulder 281.

In addition, the gunwale or upper portion 213 includes, below the shoulder 281, a laterally extending sub-portion 285 extending outwardly from the middle sub-portion 267 and including an upwardly extending leg 287 which cooperates with outer surface of the middle sub-portion 267 to define an upwardly open recess 289 located in vertical alignment with the recess 233 of the downwardly depending peripheral portion 217 of the deck member 215.

In addition, the boat 210 includes a fender strip 291 including an inner portion 293 having upper and lower ends respectively received in the downwardly open recess 233 and in the upwardly open recess 289. The fender strip 291 also includes an outer semi-cylindrical portion which extends from the inner portion 181 and which defines a fender 295.

The deck member 215 and the hull member 211 can be fixed together in any suitable fashion. In the disclosed construction, fasteners, such as screws 297, extend through the downwardly projecting sub-portion 221 of the downwardly depending peripheral portion 217 of the deck member 215, through the upper sub-portion 269 of the gunwale or upper portion 213 of the hull member 211, through the box-like screw strip formation 241 and into the wooden strip 251. Alternately, adhesive can be located between the shoulder 281 adjacent the upper end of the middle sub-portion 267 of the gunwale or upper portion 213 and lower end 225 of the downwardly projecting sub-portion 221 of the downwardly depending peripheral portion 217 of the deck member 215, and between the upper end 271 of the upper sub-portion 269 of the gunwale or upper portion 213 and the upper end 263 of the slot or recess 261. If desired, both fasteners and adhesive can be employed.

Figure 9:
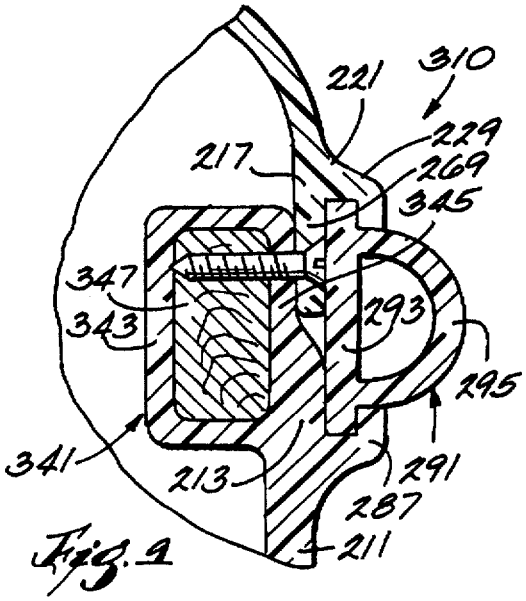
FIG. 9 is a fragmentary view of a portion of still another boat incorporating various of the features of the invention.

Shown fragmentarily in FIG. 9 is still another embodiment of a boat 310 which is constructed generally identically to the boat 210 shown in FIG. 8, except as described hereinafter in connection with the provision of the screw strip formation. In the boat 310 shown in FIG. 9, the gunwale or upper portion 213 includes a box-like screw strip formation 341 including inner and outer vertical wall portions 343 and 345 and containing a wooden screw strip 347. More specifically, in the construction shown in FIG. 9, the upper sub-portion 269 of the gunwale or upper portion 213 of the hull member 211 forms the outer vertical wall portion 345 of the box-like screw strip formation 341.

Various of the features of the invention are set forth in the following claims.

I claim:

1. A boat comprising a hull member including a gunwale having an outer peripheral surface, and a deck member including a depending peripheral portion including an inner concave surface engaged with said outer surface of said hull member with an interference fit, wherein said outer surface of said gunwale includes a centrally located recess, wherein said peripheral portion of said deck member includes an aperture communicating with said recess, and wherein said boat further includes an adhesive located in said recess and said aperture.

2. A boat in accordance with claim 1 wherein said outer surface of said hull member is outwardly convex, and wherein said inner surface of said deck member is inwardly concave.

3. A boat in accordance with claim 1 wherein one of said hull member and said deck member is fabricated of resiliently flexible material.

4. A boat in accordance with claim 1 wherein said deck member is fabricated of resiliently flexible material.

5. A boat comprising a hull member including a gunwale having an outer peripheral surface, a deck member including a depending peripheral portion, and a fender strip including an inside surface which is inwardly concave and in engagement with said outer peripheral surface of said gunwale with an interference fit, an outwardly extending fender portion, and an upwardly open recess located between said inside surface and said fender portion and receiving said peripheral portion of said deck member.

6. A boat in accordance with claim 5 wherein said depending peripheral portion includes an inner concave surface, and an outer convex surface, and wherein said recess of said fender strip includes an outwardly located convex surface in engagement with said inner concave surface of said depending peripheral portion, and an inwardly located concave surface in engagement with said outer convex surface of said depending peripheral portion.

7. A boat including a deck member having a depending portion including an inner downwardly open recess, and an outer downwardly open recess, and a hull member including a gunwale having a lower portion having a thickness, an upper portion projecting upwardly from said lower portion, having a thickness less than said thickness of said lower portion, and received in said inner recess in said depending portion of said deck member, and a laterally extending portion extending from said lower portion and including an upwardly extending leg cooperating with said upper portion to define an upwardly open recess in vertical alignment with said outer recess of said depending portion of said deck member, a fender strip including an inner portion received in said outer recess of said depending portion of said deck member and in said upwardly open recess defined by said lower portion and said laterally extending portion of said hull member, and an outer portion defining a fender, and adhesive fixing together said depending portion of said deck member and said gunwale portion of said hull member.

8. A boat in accordance with claim 7 wherein said depending portion of said deck member includes laterally spaced and vertically extending inner and outer sub-portions which define therebetween said inner recess of said depending portion of said deck member and which respectively include lower ends, wherein said inner recess of said depending portion of said deck member includes an upper end, wherein said upper portion of said gunwale includes an upper end, wherein said lower portion of said gunwale includes an inner surface, and an outer surface defining a shoulder adjacent said upper portion, and wherein said adhesive is located between said lower end of said inner sub-portion and said inner surface of said lower portion of said gunwale, and between said lower end of said outer sub-portion and said shoulder, and between said upper end of said upper portion of said gunwale and said upper end of said inner recess of said depending portion of said deck member.

9. A boat including a deck member having a depending portion including a downwardly projecting portion having an inner surface, and a laterally extending portion extending outwardly from said downwardly projecting portion and including a downwardly extending leg cooperating with said downwardly projecting portion to define a downwardly open recess, and a hull member comprising a gunwale having a lower portion having a thickness, an upper portion projecting upwardly from said lower portion, having a thickness less than said thickness of said lower portion, and engaging said inner surface of said downwardly projecting portion, and a laterally extending portion extending outwardly from said lower portion and including an upwardly extending leg cooperating with said upper portion to define an upwardly open recess in vertical alignment with said recess of said depending portion of said deck member, and a fender strip including an inner portion received in said downwardly open recess defined by said downwardly projecting portion and said laterally extending portion of said depending portion of said deck member and in said upwardly open recess defined by said lower portion and said laterally extending portion of said hull member, and an outer portion defining a fender.

10. A boat in accordance with claim 9 wherein a fastener extends through said downwardly projecting portion of said depending portion of said deck member, and through said upper portion of said gunwale of said hull member.

11. A boat in accordance with claim 10 wherein said downwardly projecting portion of said downwardly depending portion includes a lower end, wherein said lower portion of said gunwale includes an outer surface defining a shoulder adjacent said upper portion, and wherein adhesive is located between said lower end of said downwardly projecting portion of said downwardly depending portion of said deck member and said shoulder.

12. A boat in accordance with claim 11 wherein said gunwale also includes a screw strip formation including said upper portion of said gunwale of said hull member.

13. A method of manufacturing a boat comprising the steps of fabricating a deck member including a peripheral portion having a downwardly projecting sub-portion and a downwardly open recess, fabricating a hull member including a gunwale portion with an upwardly extending sub-portion extending into the downwardly open recess, fabricating one of the hull member and the deck member with a screw strip formation including an interior wooden member, and threading a screw through the downwardly projecting sub-portion, through the upwardly extending sub-portion, through the screw strip formation, and into the wooden member.

14. A method of manufacturing a boat comprising the steps of fabricating a deck member including a peripheral portion having a downwardly projecting sub-portion, a screw strip formation including an interior wooden member, and a downwardly open recess located between the downwardly projecting sub-portion and the screw strip formation, fabricating a hull member including a gunwale portion with an upwardly extending sub-portion, locating the deck member relative to the hull member so that the upwardly extending sub-portion extends into the downwardly open recess, and threading a screw through the downwardly projecting sub-portion, through the upwardly extending sub-portion, through the screw strip formation, and into the wooden member.

15. A method of manufacturing a boat comprising the steps of fabricating a deck member including a peripheral portion having a vertically downwardly projecting sub-portion, fabricating a hull member including a gunwale portion with a screw strip formation including a vertically extending wall portion and an interior wooden member, locating the deck member relative to the hull member so that the vertically downwardly projecting sub-portion of the deck member engages the vertically extending wall portion of the hull member, and threading a screw through the vertically downwardly projecting sub-portion, through the vertically extending wall portion, through the screw strip formation, and into the wooden member.

16. A boat comprising a hull member including a gunwale having an outer peripheral surface, and a deck member including a depending peripheral portion including an inner surface engaged with said outer surface of said hull member with an interference fit, wherein said outer surface of said gunwale includes a centrally located recess, wherein said inner surface of said deck member includes a recess mating with said recess in said outer surface of said gunwale, and wherein said boat further includes an adhesive located in said recesses.

17. A boat including a deck member having a depending portion including an inner downwardly open recess, and an outer downwardly open recess, and a hull member including a gunwale having a lower portion having a thickness, an upper portion projecting upwardly from said lower portion, having a thickness less than said thickness of said lower portion, and received in said inner recess in said depending portion of said deck member, and a laterally extending portion extending from said lower portion and including an upwardly extending leg cooperating with said upper portion to define an upwardly open recess in vertical alignment with said outer recess of said depending portion of said deck member, a fender strip including an inner portion received in said outer recess of said depending portion of said deck member and in said upwardly open recess defined by said lower portion and said laterally extending portion of said hull member, and an outer portion defining a fender, wherein said depending portion of said deck member includes laterally spaced and vertically extending inner and outer sub-portions, and wherein said boat further includes a fastener extending through said inner and outer sub-portions of said depending portion of said deck member, and through said upper portion of said gunwale of said hull member.

18. A boat in accordance with claim 17 wherein said depending portion of said deck member also includes a screw strip formation including said inner sub-portion of said depending portion of said deck member.

* * * * *